US010986702B2

(12) United States Patent
Gray

(10) Patent No.: US 10,986,702 B2
(45) Date of Patent: Apr. 20, 2021

(54) APPARATUS, SYSTEM, AND METHOD FOR INDUCTION HEATING

(71) Applicant: The Boeing Company, Chicago, IL (US)

(72) Inventor: Everette D. Gray, Seattle, WA (US)

(73) Assignee: The Boeing Company, Chicago, IL (US)

( * ) Notice: Subject to any disclaimer, the term of this patent is extended or adjusted under 35 U.S.C. 154(b) by 885 days.

(21) Appl. No.: 15/467,857

(22) Filed: Mar. 23, 2017

(65) Prior Publication Data

US 2018/0279424 A1 Sep. 27, 2018

(51) Int. Cl.
*H05B 6/44* (2006.01)
*H05B 6/10* (2006.01)

(52) U.S. Cl.
CPC ..... *H05B 6/44* (2013.01); *H05B 6/101* (2013.01)

(58) Field of Classification Search
CPC . H05B 6/44; H05B 6/101; H05B 6/08; H05B 6/10; H05B 6/36; H05B 6/362; H05B 6/102; H05B 6/065; H05B 6/62; H05B 6/1245; H05B 6/1272; H05B 6/1281; H05B 6/04; H05B 6/06; H05B 6/105; H05B 3/34; H05B 3/24; H05B 3/42; H05B 6/108; H05B 3/58; H01Q 13/00; H01Q 1/38; H01Q 3/22; H01Q 3/24; H01Q 3/26; H01Q 3/12; H01Q 3/14; H01Q 3/16; H01Q 13/20; H01Q 3/2605; H01Q 3/2617; H01Q 3/2664; F16L 53/004; F16L 59/20; B29C 67/0055; B29C 65/1467; B29C 66/53241; B29C 66/72321; B29C 65/7826; B29C 65/7823; B29C 66/73715; B29C 63/0069; B29C 65/66; B29C 66/87445; B29C 66/1122; B29C 65/1412; B29C 66/727; B29C 66/348; B29C 65/5057; B29C 63/42; B29C 66/71; B29C 66/91313; B29C 66/73921; B29C 66/91315; B29C 66/91651; B29C 66/73755; B29C 66/73751; B29C 66/9121;
(Continued)

(56) References Cited

U.S. PATENT DOCUMENTS 4,595,607 A * 6/1986 Betteridge ..... B05C 9/14 118/307
5,113,049 A 5/1992 Border et al.
(Continued)

OTHER PUBLICATIONS

Canadian Office Action concerning Canadian Patent Application No. 2,992,191 dated Feb. 9, 2021.

*Primary Examiner* — Tu B Hoang
*Assistant Examiner* — Diallo I Duniver
(74) *Attorney, Agent, or Firm* — Kunzler Bean & Adamson

(57) ABSTRACT

Described herein is an apparatus for induction heating. The apparatus includes a plurality of induction heating cells attachably coupled together. Each induction heating cell of the plurality of induction heating cells is movable relative to adjacent induction heating cells of the plurality of induction heating cells to conform the plurality of induction heating cells to a non-planar surface. Each induction heating cell of the plurality of induction heating cells includes a power connector and a coupling feature to couple the respective induction heating cell with one or more other induction heating cells of the plurality of induction heating cells.

20 Claims, 13 Drawing Sheets

(58) Field of Classification Search
CPC ... B29C 2035/0811; B22D 25/02; C21D 9/50; B29K 2105/0058; B29K 2023/06; B23K 37/053; B23K 37/0426; B23K 9/0282; B23K 9/235; B23K 2101/06; B23K 2101/10; B23K 2103/04; B29L 2023/225; B05D 3/0245; B05D 7/148; B05D 3/0281; B05D 1/002; B05D 7/146; B05C 9/14
USPC ..... 219/635, 639–646, 655, 656, 657, 662, 219/665, 666, 671–676, 701, 705, 219/760–763
See application file for complete search history.

(56) References Cited

U.S. PATENT DOCUMENTS

| | | | | |
|---|---|---|---|---|
| 5,378,879 | A | 1/1995 | Monovoukas | |
| 6,790,206 | B2 * | 9/2004 | Panescu | A61B 18/1206 606/34 |
| 2008/0093356 | A1 * | 4/2008 | Pizzi | H05B 3/34 219/474 |
| 2010/0282740 | A1 * | 11/2010 | Artigas Maestre | H05B 6/065 219/662 |
| 2012/0074127 | A1 | 3/2012 | Abbott | |
| 2014/0151368 | A1 * | 6/2014 | Morrison | H05B 6/105 219/674 |
| 2015/0219264 | A1 * | 8/2015 | Tailor | B32B 37/08 156/86 |
| 2016/0353527 | A1 * | 12/2016 | Wang | B22D 25/02 |

* cited by examiner

APPARATUS, SYSTEM, AND METHOD FOR INDUCTION HEATING

FIELD

This disclosure relates generally to induction heating, and more particularly to induction heating using an array of induction heating cells.

BACKGROUND

Induction heating uses an electrically conducting object to heat a part using electromagnetic induction through heat generated in the electrically conducting object by eddy currents. In certain environments, induction heating may be used to heat a part having a planar surface. In such environments, the electrically conducting object is shaped to match the planar surface. The use of induction heating on parts having non-planar surfaces may be inefficient because a shape of the electrically conducting object does not match a shape of the surface of a part to be heated.

SUMMARY

The subject matter of the present application has been developed in response to the present state of the art, and in particular, in response to shortcomings of conventional apparatuses used for induction heating, particularly induction heating of parts for the purpose of curing or heat treating the parts. For example, conventional apparatuses do not facilitate use on non-planar surfaces.

Accordingly, the subject matter of the present application has been developed to provide an apparatus, system, and method that overcome at least some of the above-discussed shortcomings of prior art techniques. More particularly, in some embodiments, described herein are apparatuses, systems, and methods for induction heating, such as induction heating of a part for curing the part, that include multiple inducting heating cells that move relative to one another to conform to non-planar surfaces.

An apparatus for induction heating includes a plurality of induction heating cells attachably coupled together. Each induction heating cell of the plurality of induction heating cells is movable relative to adjacent induction heating cells of the plurality of induction heating cells to conform the plurality of induction heating cells to a non-planar surface. Each induction heating cell of the plurality of induction heating cells includes a power connector and a coupling feature to couple the respective induction heating cell with one or more other induction heating cells of the plurality of induction heating cells. The preceding subject matter of this paragraph characterizes example 1 of the present disclosure.

The coupling feature includes at least one hinge. The preceding subject matter of this paragraph characterizes example 2 of the present disclosure, wherein example 2 also includes the subject matter according to example 1, above.

The coupling feature includes at least one wire. The preceding subject matter of this paragraph characterizes example 3 of the present disclosure, wherein example 3 also includes the subject matter according to any one of examples 1 or 2, above.

Each induction heating cell of the plurality of induction heating cells includes a data connector. The preceding subject matter of this paragraph characterizes example 4 of the present disclosure, wherein example 4 also includes the subject matter according to any one of examples 1, 2, or 3, above.

The power connector and data connector are integrated together. The preceding subject matter of this paragraph characterizes example 5 of the present disclosure, wherein example 5 also includes the subject matter according to any one of examples 1, 2, 3, or 4, above.

The power connector includes a plurality of power connectors. The preceding subject matter of this paragraph characterizes example 6 of the present disclosure, wherein example 6 also includes the subject matter according to any one of examples 1, 2, 3, 4, or 5, above.

The coupling feature includes a plurality of apertures. The preceding subject matter of this paragraph characterizes example 7 of the present disclosure, wherein example 7 also includes the subject matter according to any one of examples 1, 2, 3, 4, 5, or 6, above.

Each induction heating cell of the plurality of induction heating cells includes a thermocouple, a frequency detection sensor and port, or some combination thereof. The preceding subject matter of this paragraph characterizes example 8 of the present disclosure, wherein example 8 also includes the subject matter according to any one of examples 1, 2, 3, 4, 5, 6, or 7, above.

Each induction heating cell of the plurality of induction heating cells is individually controllable to provide induction heating. The preceding subject matter of this paragraph characterizes example 9 of the present disclosure, wherein example 9 also includes the subject matter according to any one of examples 1, 2, 3, 4, 5, 6, 7, or 8, above.

Each induction heating cell of the plurality of induction heating cells includes a coil disposed circumferentially on an electrically conductive plate, and a housing enclosing at least a portion of the electrically conductive plate. The preceding subject matter of this paragraph characterizes example 10 of the present disclosure, wherein example 10 also includes the subject matter according to any one of examples 1, 2, 3, 4, 5, 6, 7, 8, or 9, above.

Each induction heating cell of the plurality of induction heating cells includes a coil disposed in a housing. The preceding subject matter of this paragraph characterizes example 11 of the present disclosure, wherein example 11 also includes the subject matter according to any one of examples 1, 2, 3, 4, 5, 6, 7, 8, 9, or 10, above.

Each induction heating cell of the plurality of induction heating cells is controllable to a selected temperature, a selected frequency, a selected power, or some combination thereof. The preceding subject matter of this paragraph characterizes example 12 of the present disclosure, wherein example 12 also includes the subject matter according to any one of examples 1, 2, 3, 4, 5, 6, 7, 8, 9, 10, or 11, above.

A system for controlling an array of induction heating cells includes a feedback reception device that receives temperature and frequency feedback from each induction heating cell of the array of induction heating cells. Each induction heating cell of the array of induction heating cells is movable relative to adjacent induction heating cells of the array of induction heating cells to conform the array of induction heating cells to a non-planar surface. The system also includes one or more induction generators that provide power, frequency, or a combination thereof to each induction heating cell of the array of induction heating cells. The system includes a controller that controls the one or more induction generators based on the temperature and frequency feedback. The preceding subject matter of this paragraph characterizes example 13 of the present disclosure.

The one or more induction generators include a plurality of induction generators. The preceding subject matter of this paragraph characterizes example 14 of the present disclosure, wherein example 14 also includes the subject matter according to example 13, above.

Each induction generator of the plurality of induction generators is coupled to a respective induction heating cell of the array of induction heating cells. The preceding subject matter of this paragraph characterizes example 15 of the present disclosure, wherein example 15 also includes the subject matter according to any one of examples 13 or 14, above.

The one or more induction generators are frequency matching induction generators that match a frequency corresponding to one or more induction heating cells of the array of induction heating cells, a material being heated, a tool comprising the array of induction heating cells, or some combination thereof. The preceding subject matter of this paragraph characterizes example 16 of the present disclosure, wherein example 16 also includes the subject matter according to any one of examples 13, 14, or 15, above.

The one or more induction generators include a frequency matching induction generator that matches a frequency corresponding collectively to the array of induction heating cells. The preceding subject matter of this paragraph characterizes example 17 of the present disclosure, wherein example 17 also includes the subject matter according to any one of examples 13, 14, 15, or 16, above.

The one or more induction generators include a frequency matching induction generator that produces a plurality of frequency outputs that are selectively provided to corresponding induction heating cells of the array of induction heating cells. The preceding subject matter of this paragraph characterizes example 18 of the present disclosure, wherein example 18 also includes the subject matter according to any one of examples 13, 14, 15, 16, or 17, above.

A method for induction heating includes providing power, frequency, or a combination thereof to one or more induction heating cells of a plurality of induction heating cells. Each induction heating cell of the plurality of induction heating cells includes a connector for receiving power, frequency, or a combination thereof and a coupling feature to movably couple the respective induction heating cell with one or more other induction heating cells of the plurality of induction heating cells to facilitate conforming the plurality of induction heating cells to a non-planar surface. The method also includes receiving feedback from the one or more induction heating cells of the plurality of induction heating cells. The method includes adjusting the power, the frequency, or a combination thereof provided to the one or more induction heating cells of the plurality of induction heating cells in response to receiving the feedback from the one or more induction heating cells of the plurality of induction heating cells. The preceding subject matter of this paragraph characterizes example 19 of the present disclosure.

Adjusting the power, the frequency, or a combination thereof provided to the one or more induction heating cells of the plurality of induction heating cells includes individually controlling the one or more induction heating cells of the plurality of induction heating cells to a selected temperature, a selected frequency, a selected power, or some combination thereof. The preceding subject matter of this paragraph characterizes example 20 of the present disclosure, wherein example 20 also includes the subject matter according to example 19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter, they are not therefore to be considered to be limiting of its scope. The subject matter will be described and explained with additional specificity and detail through the use of the drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Figure 1:
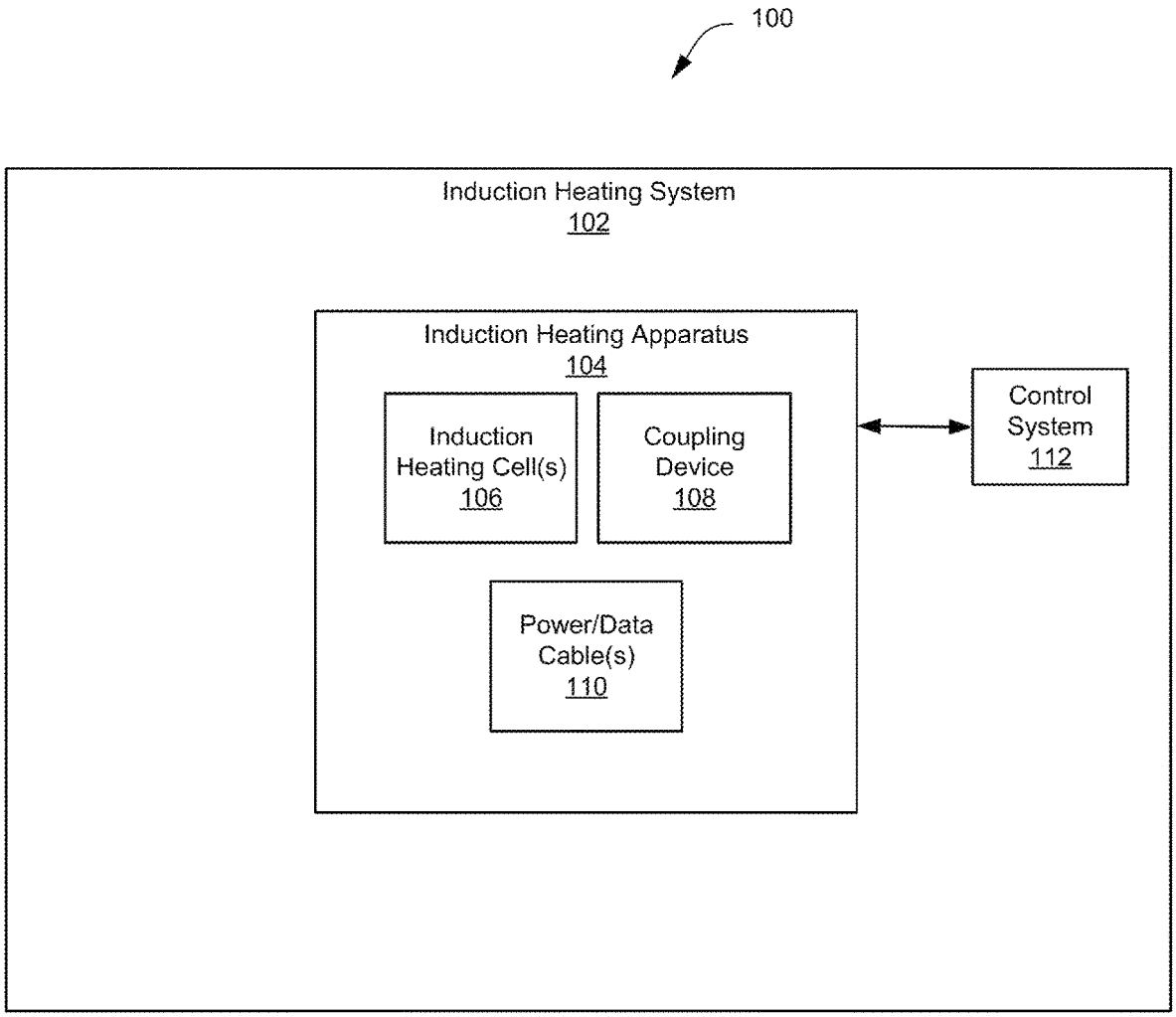
FIG. 1 is a schematic diagram of one embodiment of a system for induction heating.

FIG. 1 is a schematic diagram of one embodiment of a system 100 for induction heating. The system 100 includes an induction heating system 102 for heating a part using induction heating. Specifically, as illustrated in FIG. 1, the induction heating system 102 includes an induction heating apparatus 104 that is locatable in close proximity with a part to heat the part using electromagnetic induction. To heat the part or a tool (e.g., a tool supporting the part), eddy currents are generated within the induction heating apparatus 104 that result in the induction heating apparatus 104 generating heat.

The induction heating apparatus 104 includes one or more induction heating cells 106 each configured to generate eddy currents and provide heat in response to the eddy currents. In certain embodiments, each of the one or more induction heating cells 106 are attachably coupled together. In one embodiment, each induction heating cell of the one or more induction heating cells 106 is movable relative to adjacent induction heating cells of the one or more induction heating cells 106 to conform the one or more induction heating cells 106 to a non-planar surface. In various embodiments, each induction heating cell of the one or more induction heating cells 106 is individually controllable to provide induction heating. In some embodiments, each induction heating cell of the one or more induction heating cells 106 is controllable to a selected temperature, a selected power, and/or a selected frequency.

The induction heating apparatus 104 further includes a coupling device 108 that movably couples the one or more induction heating cells 106 together. The coupling device 108 may be any suitable device, such as one or more hinges, one or more wires, one or more cables, and so forth. In some implementations, the induction heating apparatus 104 includes a plurality of coupling devices 108 each movably coupling together one induction heating cell 106 to another adjacent induction heating cell 106.

The induction heating apparatus 104 additionally includes one or more power and/or data cables 110 that provide power and/or frequency to the one or more induction heating cells 106 and/or receive data from the one or more induction heating cells 106. The power and/or frequency is provided to the one or more induction heating cells 106 to cause the induction heating cells 106 to generate eddy currents in a metallic material, which provides heat to a part. Moreover, data may be received from the induction heating cells 106, such as temperature data, frequency data, and so forth.

The induction heating system 102 also includes a control system 112 that controls the one or more induction heating cells 106 to a desired temperature and/or frequency. In some embodiments, the control system 112 adjusts a voltage, current, and/or alternating frequency supplied to the one or more induction heating cells 106 to control the one or more induction heating cells 106 to a desired temperature and/or frequency.

Figure 2:
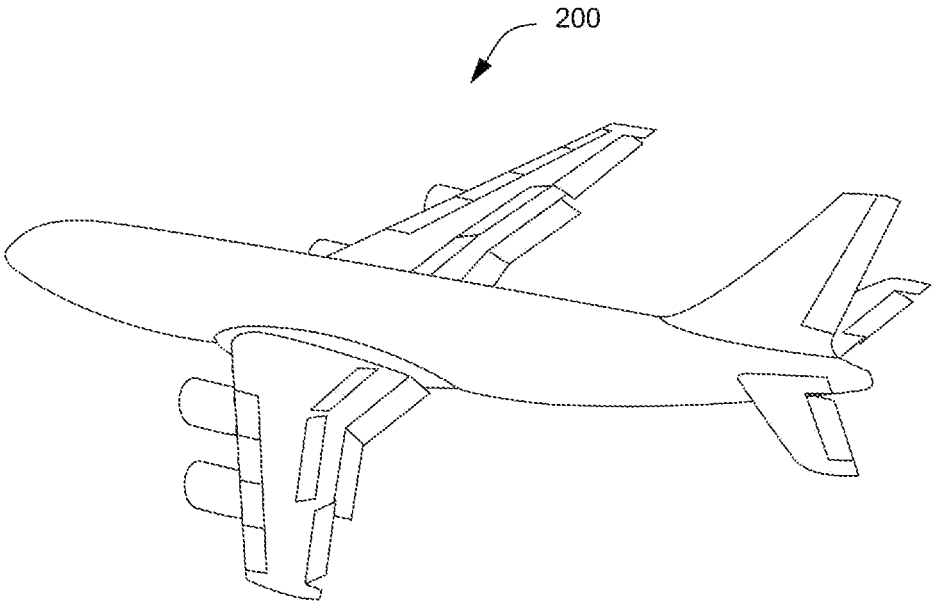
FIG. 2 is a schematic illustration of one embodiment of a system including parts that may be heated using induction heating.

FIG. 2 is a schematic illustration of one embodiment of a system 200, in the form of an aircraft, including parts heated by or formed from heat generated by the system 100. Any suitable parts may be formed from heat generated by the system 100. For example, aircraft parts, motor vehicle parts, structural parts, satellite parts, space vehicle parts, metallic parts, electronic parts, and so forth may be heated using the system 100. In one embodiment, a part of the system 200 is made from a curable material, such as an epoxy of a fiber-reinforced polymer. Such a part can be cured into a desired shape by applying the system 100 onto the part and heating the part to a curing temperature of the epoxy to cure the epoxy and form the part.

Figure 3:
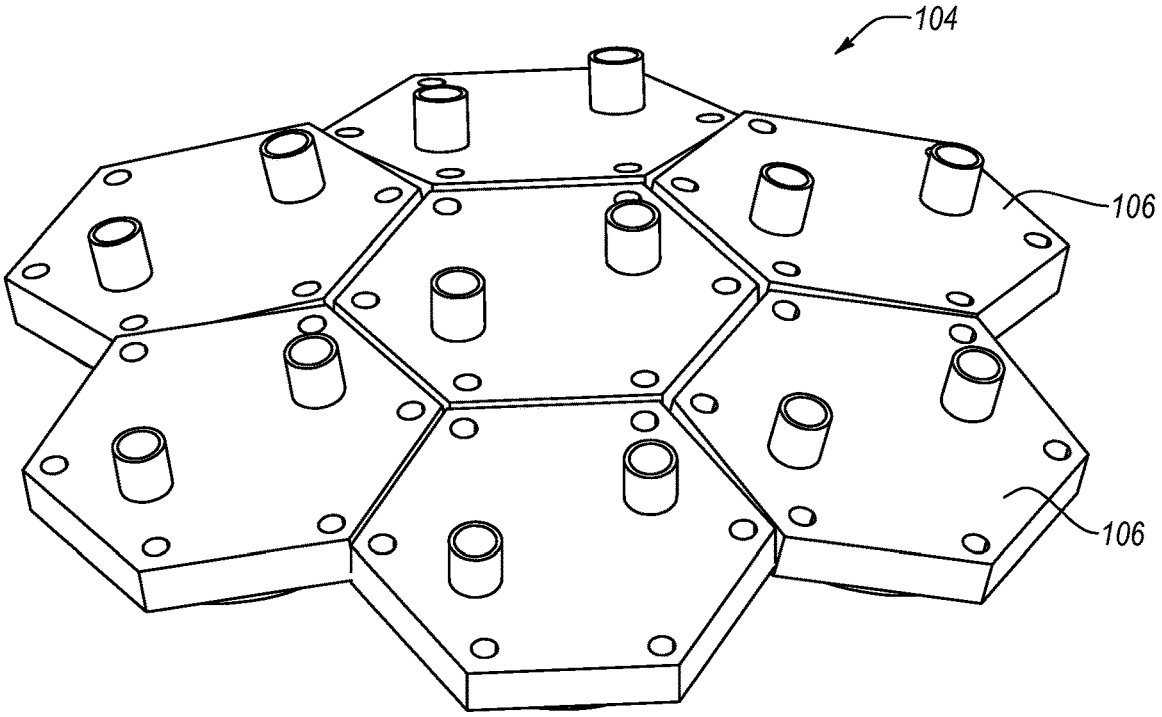
FIG. 3 is a top perspective view of one embodiment of an induction heating apparatus for heating a part using induction heating.
Figure 4:
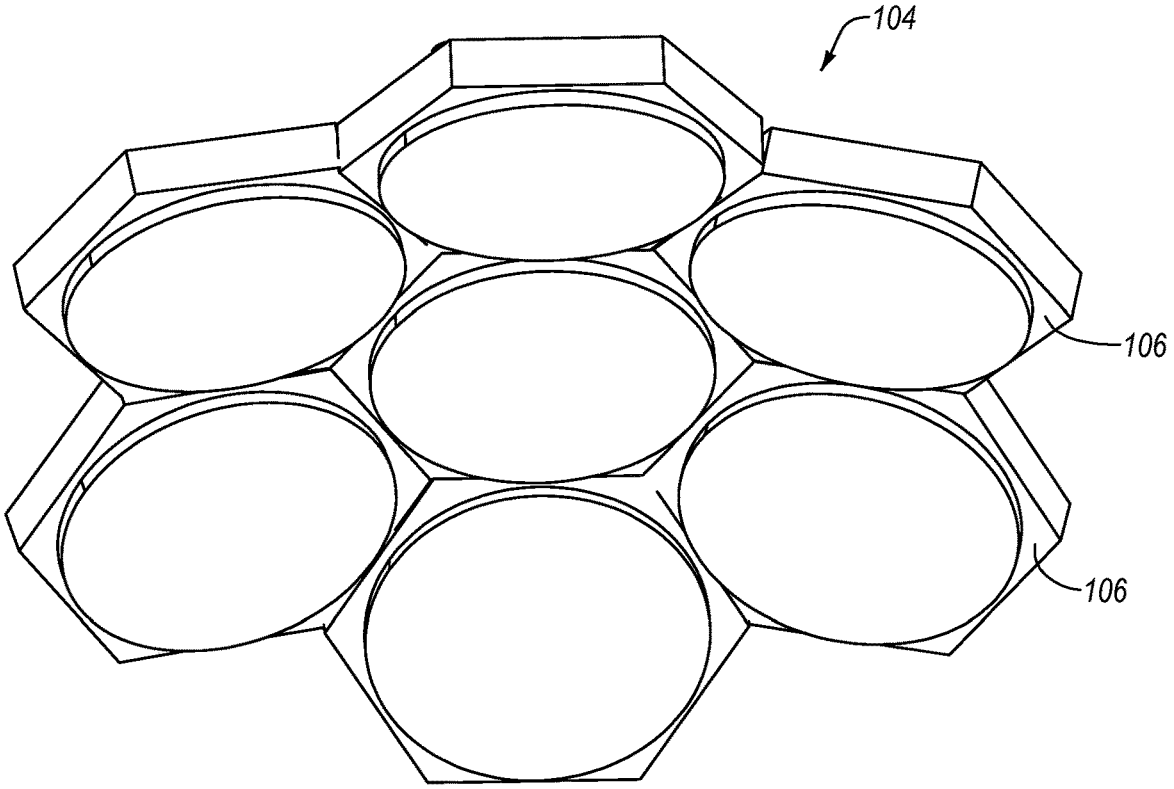
FIG. 4 is a bottom perspective view of one embodiment of an induction heating apparatus for heating a part using induction heating.

FIGS. 3 and 4 are top and bottom perspective views, respectively, of one embodiment of an induction heating apparatus 104 for heating a part using induction heating. The induction heating apparatus 104 includes multiple induction heating cells 106 movable relative to one another to conform the induction heating apparatus 104 to a non-planar surface. The induction heating apparatus 104 illustrated in FIG. 3 includes seven induction heating cells 106. However, in other embodiments, the induction heating apparatus 104 may have fewer or more than seven induction heating cells 106.

Figure 5:
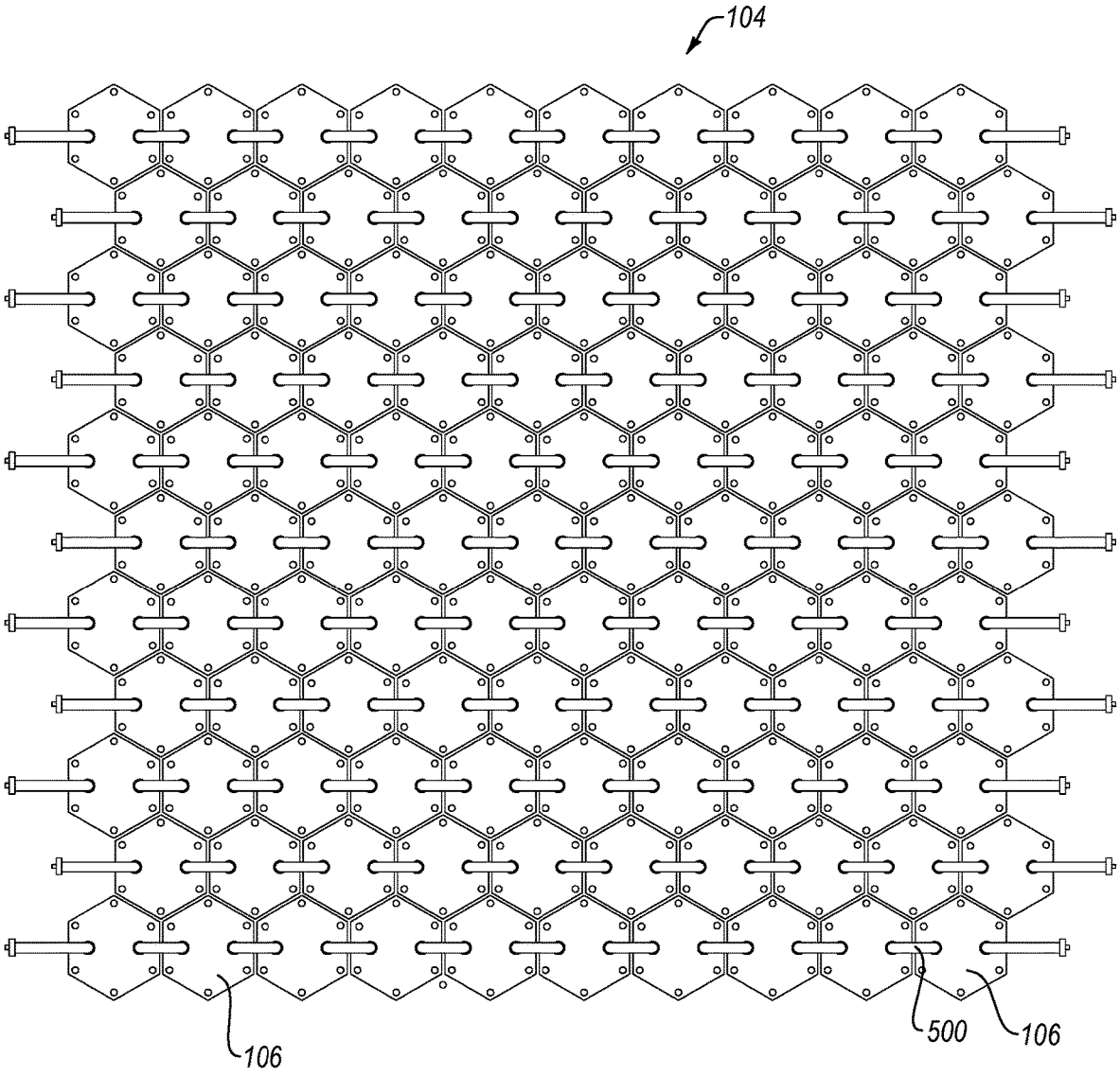
FIG. 5 is a top view of one embodiment of an induction heating apparatus for heating a part using induction heating.

FIG. 5 is a top view of one embodiment of an induction heating apparatus 104 for heating a part using induction heating. As illustrated, power cables 500 are coupled to each induction heating cell 106 to provide power and/or frequency to each induction heating cell 106. The induction heating apparatus 104 illustrated in FIG. 5 includes 110 induction heating cells 106. However, in other embodiments, the induction heating apparatus 104 may have fewer or more than 110 induction heating cells 106. The power cables 500 may include any suitable conductor for providing power and/or frequency to the induction heating cells 106. Moreover, the power cables 500 may connect one or more of the induction heating cells 106 in series. For example, each row of ten induction heating cells 106 is illustrated as connected in series using power cables 500. The illustrated array of induction heating cells 106 may conform to a non-planar part, surface, or tool that supports a part and requires heating.

Figure 6:
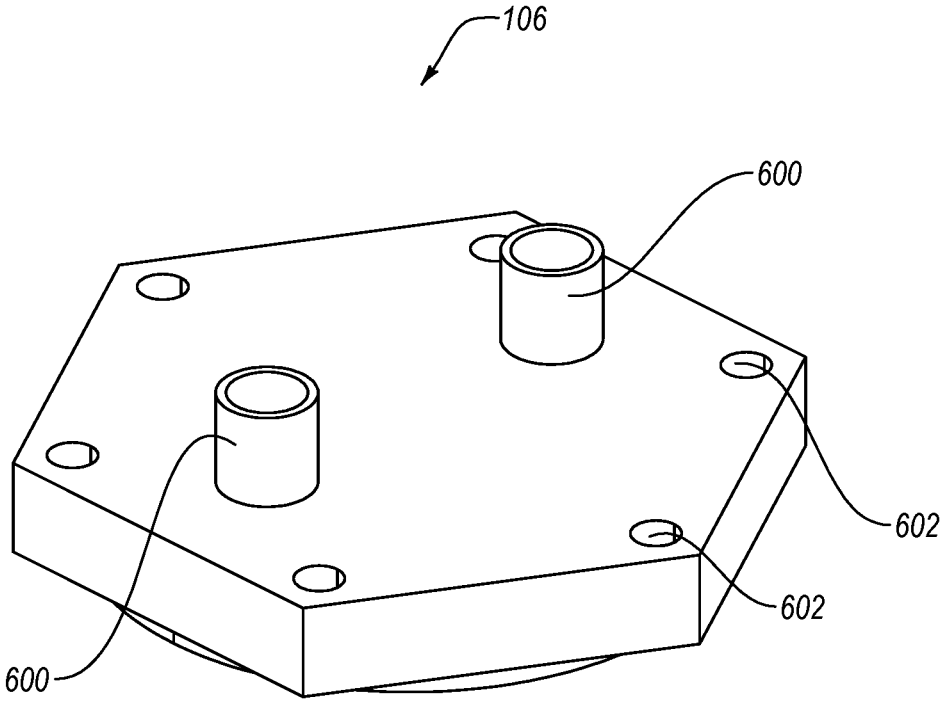
FIG. 6 is a top perspective view of one embodiment of an induction heating cell for heating a part using induction heating.

FIG. 6 is a top perspective view of one embodiment of an induction heating cell 106 for heating a part using induction heating. The induction heating cell 106 illustrated in FIG. 6 includes power and/or data connectors 600 and coupling features 602 that facilitate coupling the induction heating cell 106 with one or more other induction heating cells 106. In some embodiments, the power and/or data connectors 600 are each used to carry power, frequency, and/or data integrated together into one cable, while in other embodiments, one of the power and/or data connectors 600 is used for power and/or frequency and another of the power and/or data connectors 600 is used for data. The connectors 600 are electrically coupleable with the power cables 500 to receive power, frequency, and/or data from or transmit power, frequency, and/or data to the power cables 500. In the illustrated embodiment, two power and/or data connectors 600 are illustrated. As may be appreciated, in other embodiments, there may be fewer or more than two power and/or data connectors 600. The power and/or data connectors 600 may be used to carry power (for causing the induction heating cell 106 to generate heat), temperature data, frequency data, and/or other data.

In certain embodiments, the coupling features 602 may include apertures for inserting an object used to couple induction heating cells together. In the illustrated embodiment, the coupling features 602 include six apertures. The apertures may facilitate insertion of one or more hinges, wires, cables, etc. for coupling induction heating cells together.

As illustrated, the induction heating cell 106 may have a hexagonal shape, or any suitable shape, such as triangular, square, rectangular, octagonal, and so forth. As may be appreciated, the shape of the induction heating cell 106 may facilitate moving the induction heating cells of an array of induction heating cells relative to one another to conform the array of induction heating cells to a non-planar surface.

Figure 7:
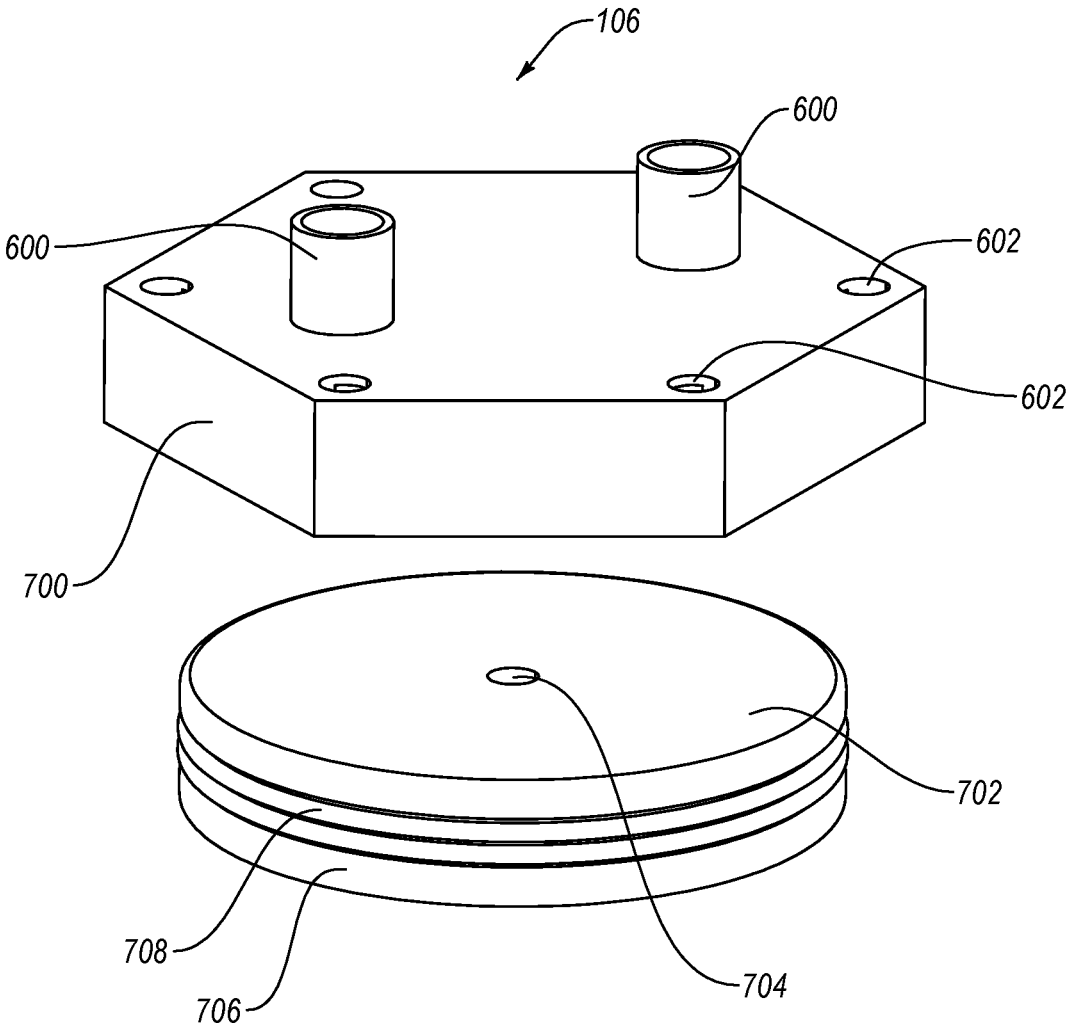
FIG. 7 is an exploded top view of one embodiment of an induction heating cell for heating a part using induction heating.

FIG. 7 is an exploded top view of one embodiment of an induction heating cell 106 for heating a part using induction heating. The induction heating cell 106 of FIG. 7 includes a housing 700 having the power and/or data connectors 600 extending from a side of the housing 700.

Additionally, the induction heating cell 106 includes an electrically conductive plate 702 (e.g., ferromagnetic plate) configured to be inserted into a lower side of the housing 700 such that the housing 700 covers at least a portion of the electrically conductive plate 702. While various embodiments describe the plate 702 as being electrically conductive, in some embodiments, the plate 702 may be manufactured from either conductive or non-conductive materials. The electrically conductive plate 702 includes an aperture 704 that may facilitate insertion of a thermocouple, a frequency detection device, and so forth. In some embodiments, the aperture 704 facilitates insertion of the electrically conductive plate 702 into the housing 700. The electrically conductive plate 702 also includes a circumferential groove 706 into which a coil 708 is disposed. The coil 708 includes a wire (e.g., an enameled magnet wire) that is wound around the electrically conductive plate 702 within the circumferential groove 706 to form a solenoid. The turns of the coil 708 generate a magnetic field when an AC current flows through the coil 708. The magnitude and frequency of the magnetic field is adjustable by adjusting the power and frequency of the AC current. The magnetic field generated by the coil 708 enters into the electrically conductive plate 702 and induces the formation of eddy currents within the electrically conductive plate 702. The eddy currents act to generate heat within the electrically conductive plate 702. Accordingly, in response to power and/or frequency being provided to the coil 708, the electrically conductive plate 702 is heated. The heat from the electrically conductive plate 702 can then be transferred, such as conduction or convection, to the part to heat the part. It should be noted that while the embodiment illustrated in FIG. 7 includes the electrically conductive plate 702, other embodiments may include the coil 708 disposed in the housing 700 without the electrically conductive plate 702. In such embodiments, the coil 708 may directly heat the part by inducing the formation of eddy currents in the part itself, or may directly heat an electrically conductive tool supporting the part.

Figure 8:
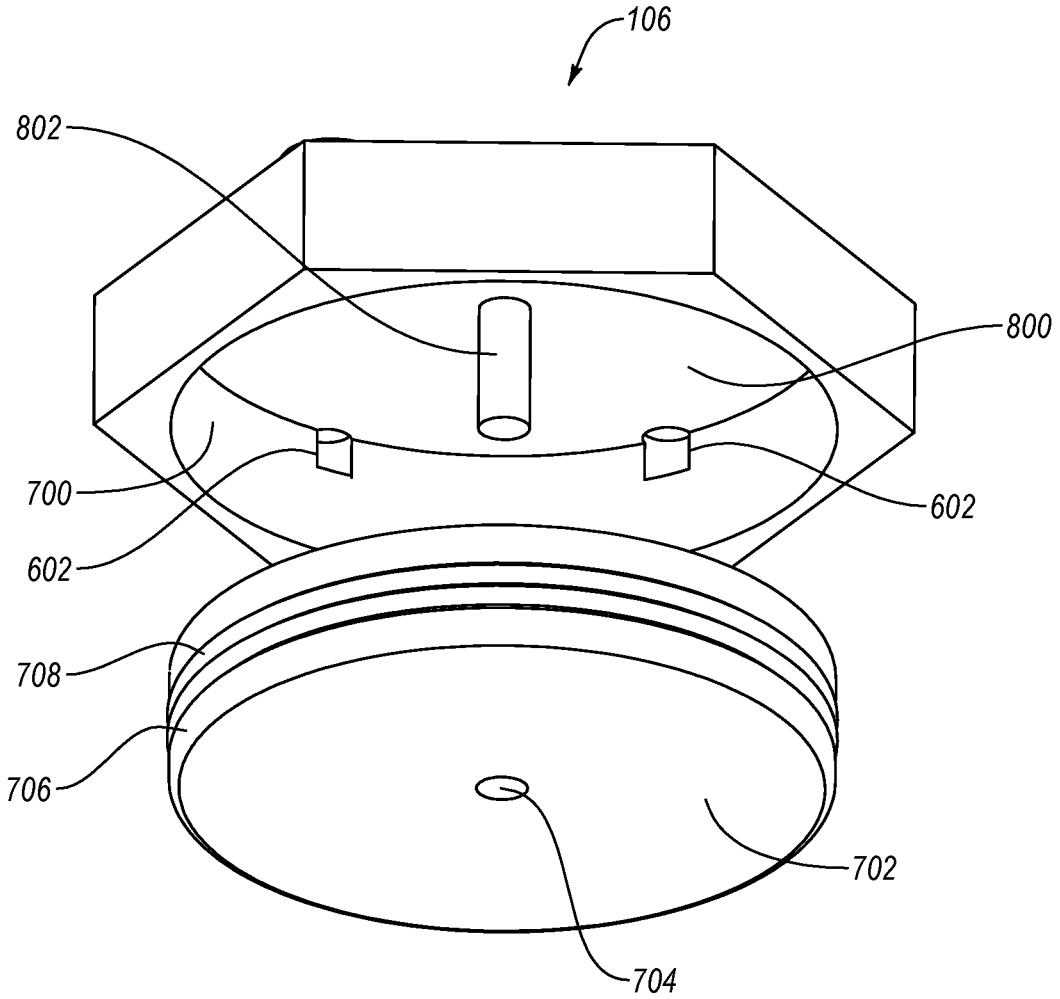
FIG. 8 is an exploded bottom view of one embodiment of an induction heating cell for heating a part using induction heating.

FIG. 8 is an exploded bottom view of the induction heating cell 106 of FIG. 7. As illustrated, the housing 700 includes a cavity 800 configured to receive and at least partially enclose the electrically conductive plate 702. Moreover, the housing 700 includes a port 802 that is inserted into the aperture 704 of the electrically conductive plate 702. In some embodiments, the port 802 may be a thermocouple and/or a frequency detection port. In various embodiments, the frequency detection port includes a frequency detection sensor.

Figure 9:
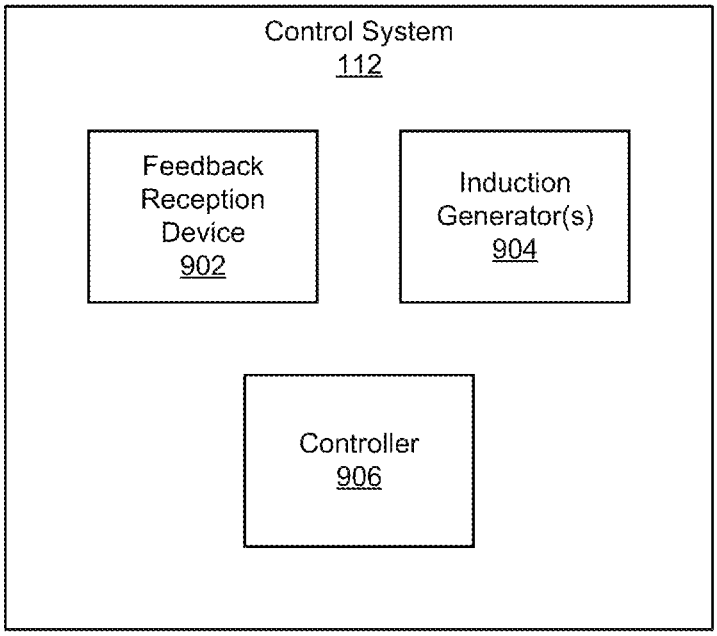
FIG. 9 is a schematic diagram of one embodiment of a system for controlling an array of induction heating cells.

FIG. 9 is a schematic block diagram of one embodiment of the control system 112. The control system 112 includes a feedback reception device 902, one or more induction generators 904, and a controller 906.

In some embodiments, the feedback reception device 902 receives temperature and/or frequency feedback from each induction heating cell of an array of induction heating cells (e.g., multiple induction heating cells coupled together). In certain embodiments, each induction heating cell of the array of induction heating cells is movable relative to adjacent induction heating cells of the array of induction heating cells to conform the array of induction heating cells to a non-planar surface.

In certain embodiments, the one or more induction generators 904 provide power and/or frequency to each induction heating cell of the array of induction heating cells. In various embodiments, the one or more induction generators are frequency matching induction generators that match a frequency corresponding to one or more induction heating cells of the array of induction heating cells, a material being heated, and/or a tool comprising the array of induction heating cells. In one embodiment, the controller 906 controls the one or more induction generators based on the temperature and/or frequency feedback.

Figure 10:
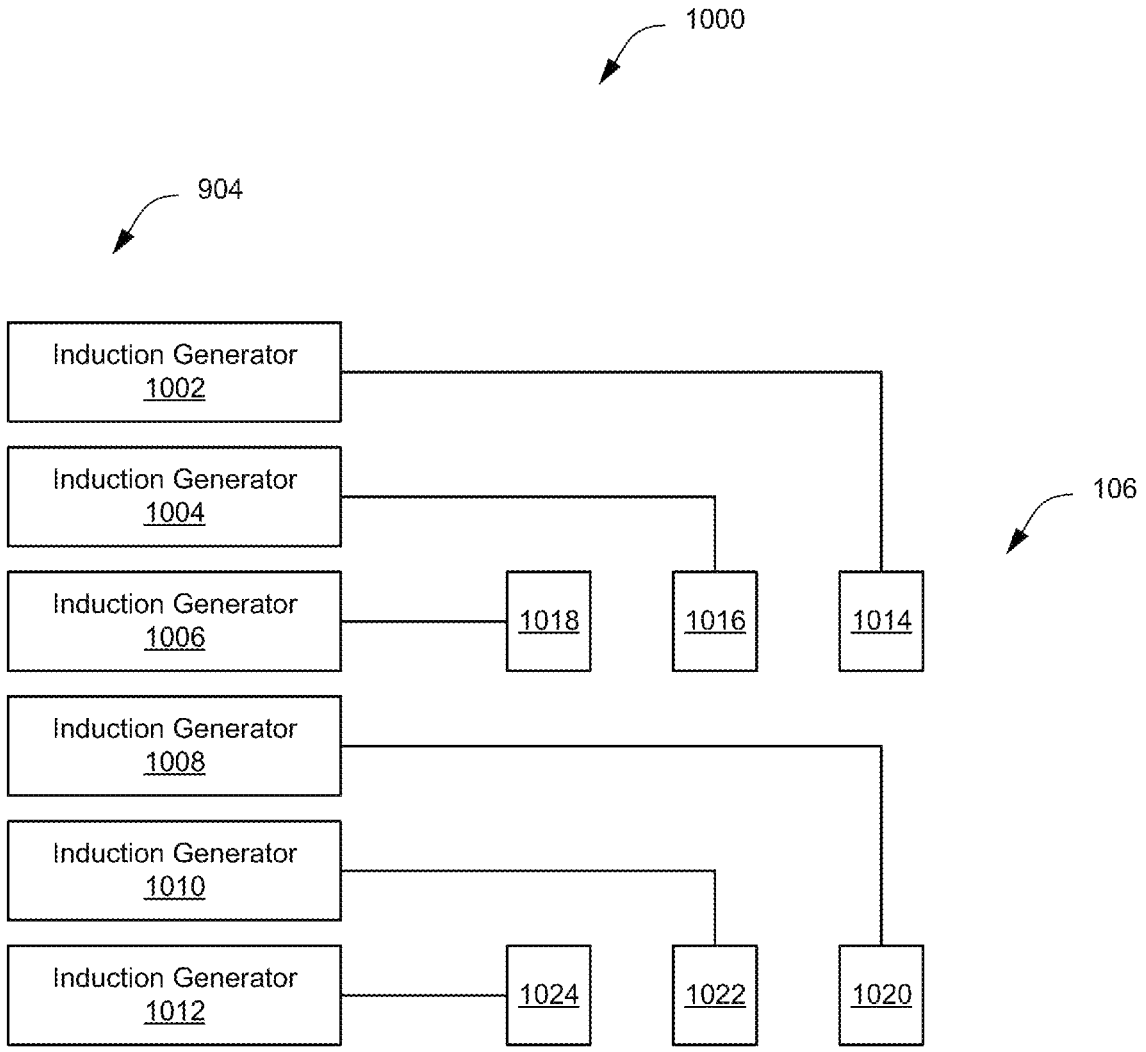
FIG. 10 is a schematic diagram of one embodiment of multiple induction generators of a system for controlling an array of induction heating cells.

FIG. 10 is a schematic diagram of one embodiment of multiple induction generators of a system 1000 for controlling an array of induction heating cells. The system 1000 includes induction generators 904 and induction heating cells 106. As illustrated, each induction generator 904 is coupled to a respective induction heating cell 106. Accordingly, an induction generator 904 coupled to an induction heating cell 106 may directly provide a frequency specific to the induction heating cell 106 to which the induction generator 904 is coupled.

Specifically, the induction generators 904 include induction generators 1002, 1004, 1006, 1008, 1010, and 1012. Moreover, the induction heating cells 106 include induction heating cells 1014, 1016, 1018, 1020, 1022, and 1024. The induction generator 1002 is directly coupled to the induction heating cell 1014 to provide the induction heating cell 1014 with a power signal having a frequency specific to the induction heating cell 1014. Further, the induction generator 1004 is directly coupled to the induction heating cell 1016 to provide the induction heating cell 1016 with a power signal having a frequency specific to the induction heating cell 1016. In addition, the induction generator 1006 is directly coupled to the induction heating cell 1018 to provide the induction heating cell 1018 with a power signal having a frequency specific to the induction heating cell 1018. Moreover, the induction generator 1008 is directly coupled to the induction heating cell 1020 to provide the induction heating cell 1020 with a power signal having a frequency specific to the induction heating cell 1020. Further, the induction generator 1010 is directly coupled to the induction heating cell 1022 to provide the induction heating cell 1022 with a power signal having a frequency specific to the induction heating cell 1022. In addition, the induction generator 1012 is directly coupled to the induction heating cell 1024 to provide the induction heating cell 1024 with a power signal having a frequency specific to the induction heating cell 1024.

Figure 11:
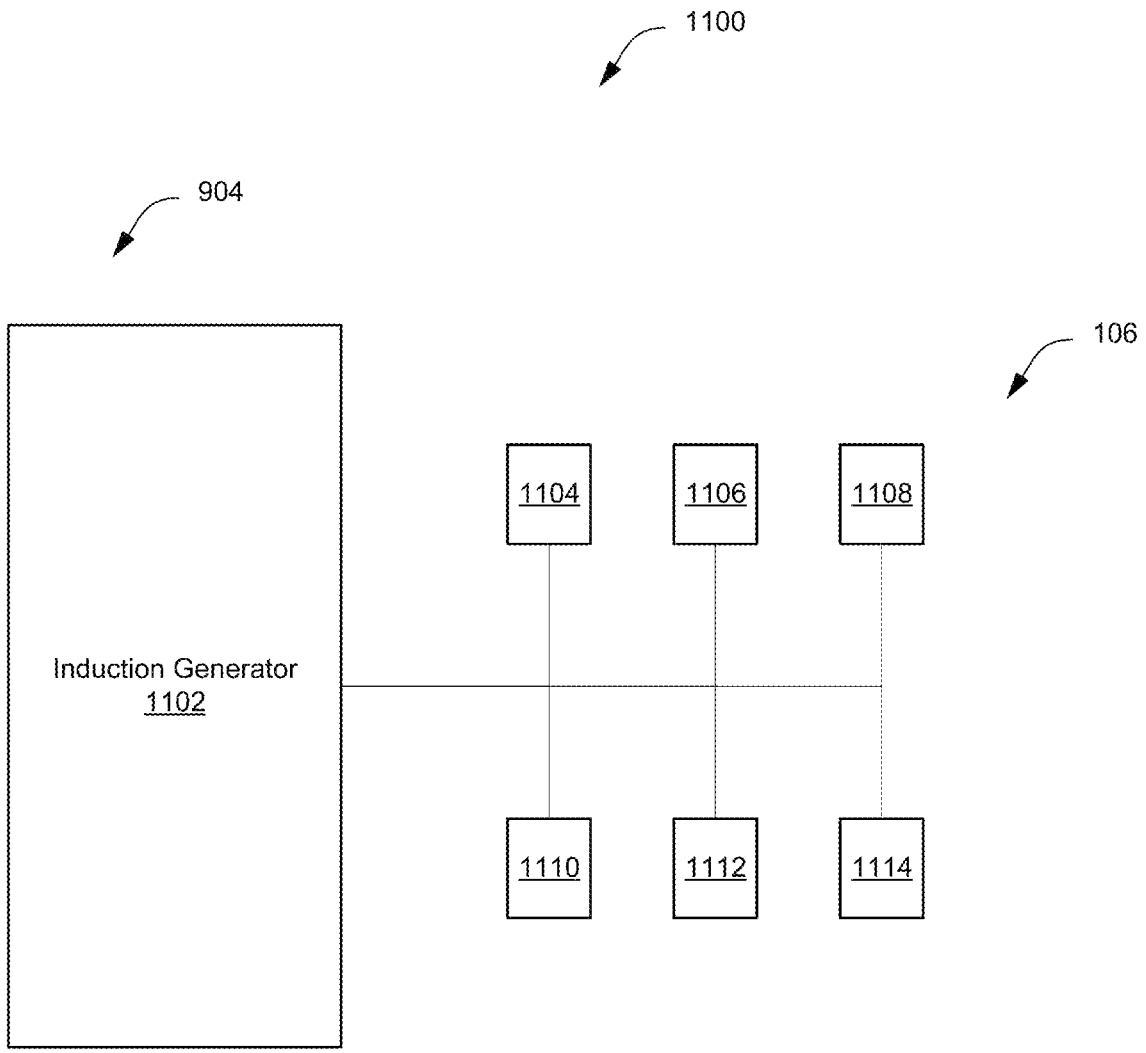
FIG. 11 is a schematic diagram of one embodiment of one induction generator of a system for controlling an array of induction heating cells.

FIG. 11 is a schematic diagram of one embodiment of one induction generator of a system 1100 for controlling an array of induction heating cells. The system 1100 includes one induction generator 904 and multiple induction heating cells 106. In certain embodiments, the one induction generator 904 includes a frequency matching induction generator that matches a frequency corresponding collectively to the multiple induction heating cells 106. For example, the induction generator 904 may provide an output power having a frequency that is an average of the frequency (e.g., consolidated feedback) that would match the induction heating cells 106.

As illustrated, the induction generator 904 includes induction generator 1102, and the induction heating cells 106 include induction heating cells 1104, 1106, 1108, 1110, 1112, and 1114. The induction generator 1102 is directly coupled to each of the induction heating cells 1104, 1106, 1108, 1110, 1112, and 1114.

Figure 12:
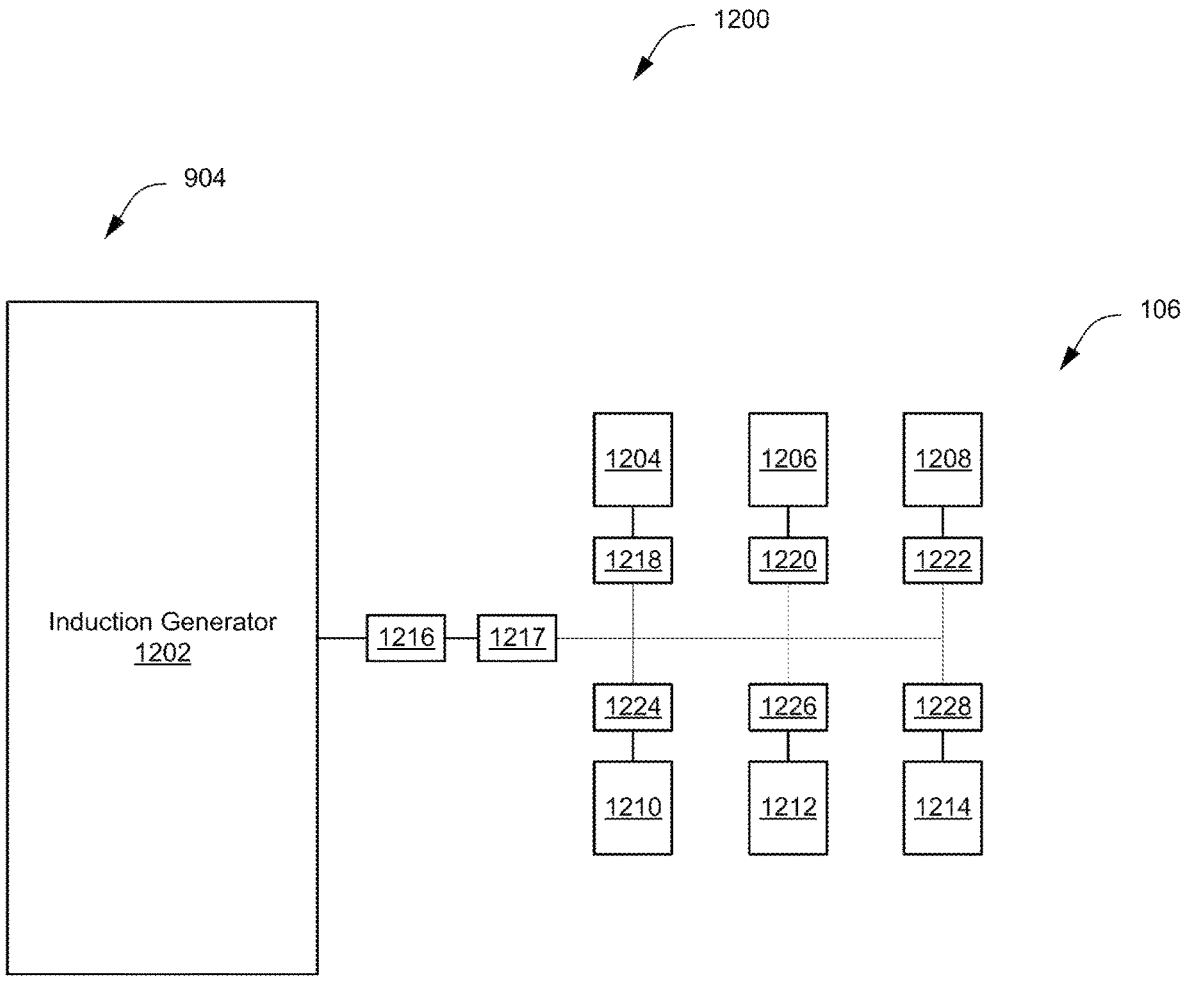
FIG. 12 is a schematic diagram of another embodiment of one induction generator of a system for controlling an array of induction heating cells.

FIG. 12 is a schematic diagram of another embodiment of one induction generator of a system 1200 for controlling an array of induction heating cells. The system 1200 includes one induction generator 904 and multiple induction heating cells 106. In some embodiments, the induction generator 904 is a frequency matching induction generator that produces a plurality of frequency outputs that are selectively provided to corresponding induction heating cells 106.

As illustrated, the induction generator 904 includes induction generator 1202, and the induction heating cells 106 include induction heating cells 1204, 1206, 1208, 1210, 1212, and 1214. The induction generator 1202 is indirectly coupled to each of the induction heating cells 1204, 1206, 1208, 1210, 1212, and 1214. Each of the induction heating cells 1204, 1206, 1208, 1210, 1212, and 1214 is assigned a unique identifier. The induction generator 1202 assign unique identifiers to each specific power frequency output as a header packet as the frequencies are generated sequentially (e.g., in series) by the induction generator 1202. The unique identifier identifies the induction heating cell that a specific power frequency output is generated for and directed toward. A sequential signal 1216 is provided from the induction generator 1202 to a controller 1217. The controller 1217 uses the unique identifier located with each specific power frequency output to direct the power frequency output to the correct induction heating cell in the array. Moreover, as illustrated, each induction heating cell has a corresponding control module 1218, 1220, 1222, 1224, 1226, and 1228 positioned between the induction generator 1202 and the induction heating cells 1204, 1206, 1208, 1210, 1212, and 1214 to direct the specific power frequency outputs toward an induction heating cell identified by a respective unique identifier. Furthermore, the control modules 1218, 1220, 1222, 1224, 1226, and 1228 attach a unique identifier to returning frequency and/or power pulses that are directed back to the induction generator 1202.

Figure 13:
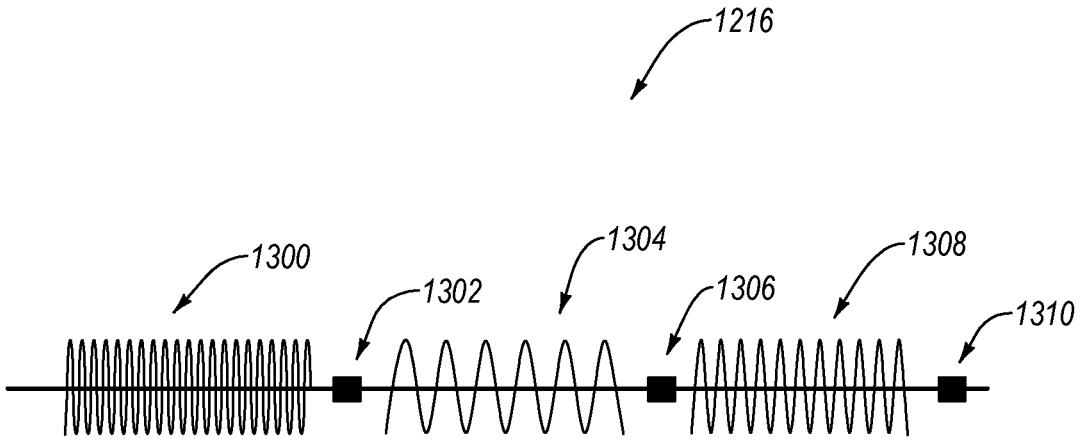
FIG. 13 is a schematic diagram of one embodiment of an induction generator frequency and power output with induction cell locating signal blocks.

FIG. 13 is a schematic diagram of one embodiment of an induction generator frequency and power output with induction cell locating signal blocks. A snapshot of an embodiment of the sequential signal 1216 is illustrated. As one example signal, the induction generator 1202 may provide a first power frequency output 1300 having a first cell header assignment packet 1302 sent prior to the first power frequency output 1300 and that indicates which induction heating cell the first power frequency output 1300 is directed to. As another example signal, the induction generator 1202 may provide a second power frequency output 1304 having a second cell header assignment packet 1306 sent prior to the second power frequency output 1304 and that indicates which induction heating cell the second power frequency output 1304 is directed to. As a further example signal, the induction generator 1202 may provide a third power frequency output 1308 having a third cell header assignment packet 1310 sent prior to the third power frequency output 1308 and that indicates which induction heating cell the third power frequency output 1308 is directed to. With the cell header assignment packets, the power frequency outputs may be provided to an intended induction heating cell using a single induction generator 1202.

Figure 14:
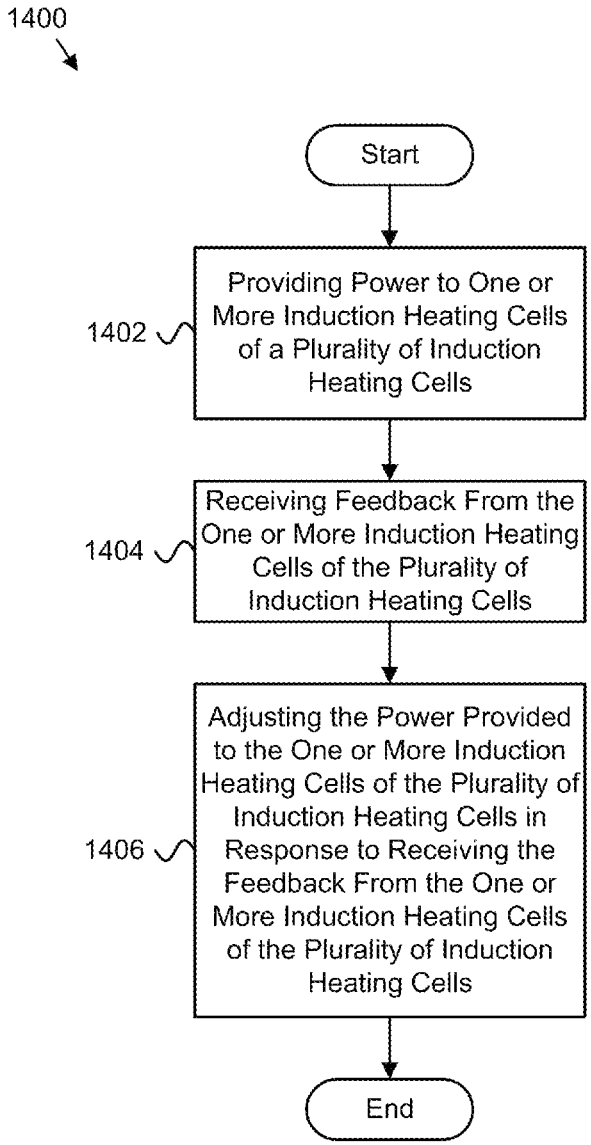
FIG. 14 is a schematic flow diagram of one embodiment of a method for induction heating.

FIG. 14 is a schematic flow diagram of one embodiment of a method 1400 for inspecting a part for defects according to one embodiment. The method 1400 includes providing 1402 power and/or frequency to one or more induction heating cells of a plurality of induction heating cells. In certain embodiments, each induction heating cell of the plurality of induction heating cells includes a connector for receiving power and/or frequency and a coupling feature to movably couple the respective induction heating cell with one or more other induction heating cells of the plurality of induction heating cells to facilitate conforming the plurality of induction heating cells to a non-planar surface.

The method 1400 includes receiving 1404 feedback from the one or more induction heating cells of the plurality of induction heating cells. The method 1400 also includes adjusting 1406 the power and/or frequency provided to the one or more induction heating cells of the plurality of induction heating cells in response to receiving the feedback from the one or more induction heating cells of the plurality of induction heating cells. In certain embodiments, adjusting 1406 the power and/or frequency provided to the one or more induction heating cells of the plurality of induction heating cells includes individually controlling the one or more induction heating cells of the plurality of induction heating cells to a selected temperature, a selected power, and/or a selected frequency.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Embodiments of the modules of the controller 112 may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments may take the form of a program product embodied in one or more computer readable storage devices storing machine readable code, computer readable code, and/or program code, referred hereafter as code. The storage devices may be tangible, non-transitory, and/or non-transmission. The storage devices may not embody signals. In a certain embodiment, the storage devices only employ signals for accessing code.

The modules of the controller 112 may be implemented as a hardware circuit comprising custom VLSI circuits or gate arrays, off-the-shelf semiconductors such as logic chips, transistors, or other discrete components. The modules of the controller 112 may also be implemented in programmable hardware devices such as field programmable gate arrays, programmable array logic, programmable logic devices or the like.

The modules of the controller 112 may also be implemented in code and/or software for execution by various types of processors. An identified module of code may, for instance, comprise one or more physical or logical blocks of executable code which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different computer readable storage devices. Where a module or portions of a module are implemented in software, the software portions are stored on one or more computer readable storage devices.

Any combination of one or more computer readable medium may be utilized by the modules of the controller 112. The computer readable medium may be a computer readable storage medium. The computer readable storage medium may be a storage device storing the code. The storage device may be, for example, but not limited to, an electronic, magnetic, optical, electromagnetic, infrared, holographic, micromechanical, or semiconductor system, apparatus, or device, or any suitable combination of the foregoing.

More specific examples (a non-exhaustive list) of the storage device would include the following: an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Code for carrying out operations for embodiments may be written in any combination of one or more programming languages including an object oriented programming language such as Python, Ruby, Java, Smalltalk, C++, or the like, and conventional procedural programming languages, such as the "C" programming language, or the like, and/or machine languages such as assembly languages. The code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present subject matter may be embodied in other specific forms without departing from its spirit or essential characteristics. The described embodiments are to be considered in all respects only as illustrative and not restrictive.

All changes which come within the meaning and range of equivalency of the claims are to be embraced within their scope.

What is claimed is:

1. An apparatus for induction heating, the apparatus comprising:

a plurality of induction heating cells attachably coupled together such that the plurality of induction heating cells is conformable to any one of a plurality of non-planar surfaces, and wherein each induction heating cell of the plurality of induction heating cells comprises:

a power connector;

a coupling feature to movably couple the respective induction heating cell with one or more other induction heating cells of the plurality of induction heating cells;

a flat electrically-conductive plate; and a coil configured to generate a magnetic field that enters the flat electrically-conductive plate for generating heat within the flat electrically-conductive plate; wherein:

the plurality of induction heating cells comprises at least a first induction heating cell, a second induction heating cell, and a third induction heating cell;

the first induction heating cell is pivotably coupled directly to the second induction heating cell and pivotably coupled directly to the third induction heating cell;

the first induction heating cell is pivotable about a first axis relative to the second induction heating cell and pivotable about a second axis relative to the third induction heating cell; and the first axis is non-parallel relative to the second axis.

2. The apparatus of claim 1, wherein the coupling feature comprises at least one hinge or at least one wire.

3. The apparatus of claim 1, wherein:

the second induction heating cell is pivotably coupled directly to the third induction heating cell; and the second induction heating cell is pivotable about a third axis relative to the third induction heating cell, the third axis is non-parallel relative to the first axis and the second axis.

4. The apparatus of claim 1, wherein each induction heating cell of the plurality of induction heating cells comprises a data connector.

5. The apparatus of claim 4, wherein the power connector and data connector are integrated together.

6. The apparatus of claim 1, wherein the power connector comprises a plurality of power connectors.

7. The apparatus of claim 1, wherein the coupling feature comprises a plurality of apertures.

8. The apparatus of claim 1, wherein each induction heating cell of the plurality of induction heating cells comprises a thermocouple, a frequency detection sensor and port, or some combination thereof.

9. The apparatus of claim 1, wherein each induction heating cell of the plurality of induction heating cells is individually controllable to provide induction heating.

10. The apparatus of claim 1, wherein the coil is disposed circumferentially on the flat electrically-conductive plate, and each induction heating cell of the plurality of induction heating cells comprises a housing enclosing at least a portion of the flat electrically-conductive plate.

11. The apparatus of claim 1, wherein each induction heating cell of the plurality of induction heating cells comprises a housing and the coil is disposed in the housing.

12. The apparatus of claim 1, wherein each induction heating cell of the plurality of induction heating cells is controllable to a selected temperature, a selected frequency, a selected power, or some combination thereof.

13. A system for controlling an array of induction heating cells, the system comprising:

an array of induction heating cells attachably coupled together such that the array of induction heating cells is conformable to any one of a plurality of non-planar surfaces, and wherein each induction heating cell of the array of induction heating cells comprises:

a power connector;

a coupling feature to movably couple the respective induction heating cell with one or more other induction heating cells of the plurality of induction heating cells;

a flat electrically-conductive plate; and a coil configured to generate a magnetic field that enters the flat electrically-conductive plate for generating heat within the flat electrically-conductive plate;

a feedback reception device that receives temperature and frequency feedback from each induction heating cell of the array of induction heating cells;

one or more induction generators that provide power, frequency, or a combination thereof to each induction heating cell of the array of induction heating cells; and a controller that controls the one or more induction generators based on the temperature and frequency feedback;

wherein:

the plurality of induction heating cells comprises at least a first induction heating cell, a second induction heating cell, and a third induction heating cell;

the first induction heating cell is pivotably coupled directly to the second induction heating cell and pivotably coupled directly to the third induction heating cell;

the first induction heating cell is pivotable about a first axis relative to the second induction heating cell and pivotable about a second axis relative to the third induction heating cell; and the first axis is non-parallel relative to the second axis.

14. The system of claim 13, wherein the one or more induction generators comprises a plurality of induction generators.

15. The system of claim 14, wherein each induction generator of the plurality of induction generators is coupled to a respective induction heating cell of the array of induction heating cells.

16. The system of claim 13, wherein the one or more induction generators are frequency matching induction generators that match a frequency corresponding to one or more induction heating cells of the array of induction heating cells, a material being heated, a tool comprising the array of induction heating cells, or some combination thereof.

17. The system of claim 13, wherein the one or more induction generators comprises a frequency matching induction generator that matches a frequency corresponding collectively to the array of induction heating cells.

18. The system of claim 13, wherein the one or more induction generators comprises a frequency matching induction generator that produces a plurality of frequency outputs that are selectively provided to corresponding induction heating cells of the array of induction heating cells.

19. A method for induction heating, the method comprising:

providing a plurality of induction heating cells attachably coupled together such that the plurality of induction heating cells is conformable to any one of a plurality of non-planar surfaces, and wherein each induction heating cell of the plurality of induction heating cells comprises:

a power connector;

a coupling feature to movably couple the respective induction heating cell with one or more other induction heating cells of the plurality of induction heating cells;

a flat electrically-conductive plate; and a coil configured to generate a magnetic field that enters the flat electrically-conductive plate for generating heat within the flat electrically-conductive plate;

providing power, frequency, or a combination thereof to one or more induction heating cells of the plurality of induction heating cells;

receiving feedback from the one or more induction heating cells of the plurality of induction heating cells; and adjusting the power, the frequency, or a combination thereof provided to the one or more induction heating cells of the plurality of induction heating cells in response to receiving the feedback from the one or more induction heating cells of the plurality of induction heating cells;

wherein:

the plurality of induction heating cells comprises at least a first induction heating cell, a second induction heating cell, and a third induction heating cell;

the first induction heating cell is pivotably coupled directly to the second induction heating cell and pivotably coupled directly to the third induction heating cell;

the first induction heating cell is pivotable about a first axis relative to the second induction heating cell and pivotable about a second axis relative to the third induction heating cell; and the first axis is non-parallel relative to the second axis.

20. The method of claim 19, wherein adjusting the power, the frequency, or a combination thereof provided to the one or more induction heating cells of the plurality of induction heating cells comprises individually controlling the one or more induction heating cells of the plurality of induction heating cells to a selected temperature, a selected frequency, a selected power, or some combination thereof.

* * * * *